US007011334B2

(12) United States Patent
Holzer

(10) Patent No.: US 7,011,334 B2
(45) Date of Patent: Mar. 14, 2006

(54) BINDING MECHANISM FOR SPORTS DEVICES, IN PARTICULAR FOR A SNOWBOARD

(75) Inventor: Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 65 days.

(21) Appl. No.: 10/353,178

(22) Filed: Jan. 28, 2003

(65) Prior Publication Data

US 2003/0146600 A1 Aug. 7, 2003

(30) Foreign Application Priority Data

Feb. 1, 2002 (AT) ..... A 168/2002

(51) Int. Cl.
*A63C 9/00* (2006.01)

(52) U.S. Cl. ..... 280/618; 280/14.22; 280/11.3

(58) Field of Classification Search ..... 36/117.1, 36/58.6; 280/607, 608, 609, 14.21, 14.22, 280/14.23, 611, 616, 617, 618, 11.3, 623
See application file for complete search history.

(56) References Cited

U.S. PATENT DOCUMENTS 4,203,235 A * 5/1980 Van Pelt, Jr. ..... 36/118.8
4,922,633 A * 5/1990 Sartor ..... 36/118.9
4,979,760 A * 12/1990 Derrah ..... 280/607
5,046,268 A * 9/1991 Munari ..... 36/117.8
5,632,105 A * 5/1997 Bonaventure ..... 36/117.1
5,636,455 A * 6/1997 Meiselman ..... 36/115
5,727,797 A * 3/1998 Bowles ..... 280/14.21
5,891,072 A * 4/1999 Cady, Jr. ..... 602/27
6,116,635 A 9/2000 Rigal
6,123,342 A * 9/2000 Grell ..... 280/11.36
6,206,403 B1 * 3/2001 Black et al. ..... 280/618
6,533,295 B1 * 3/2003 Gonthier ..... 280/14.22

(Continued)

FOREIGN PATENT DOCUMENTS

EP 1 127 592 8/2001

(Continued)

*Primary Examiner*—Christopher P. Ellis
*Assistant Examiner*—Kelly E. Campbell
(74) *Attorney, Agent, or Firm*—Collard & Roe P.C.

(57) ABSTRACT

The invention relates to a binding mechanism (1) for sports devices (2), in particular for a snowboard (4), provided with a base plate (11) for fixing to a sports device (2) and for supporting a sports shoe (3), on which a support (25) is retained, aligned substantially perpendicular thereto for supporting the rearward cuff region or back region of a sports shoe (3). This support (25) is mounted so as to be pivotable about a pivot axis (27) and is restricted by stops extending substantially parallel with the standing plane (19) of the base plate (11) and substantially transversely to the binding longitudinal axis (18). This support (25) consists of at least a first and a second support part (38, 39), at least partially overlapping, and arranged one after the other in the direction of the binding longitudinal axis (18). An adjusting mechanism (43) is provided for adjusting a distance (42) between the first support part (38) and the second support part (39) in the direction of the binding longitudinal axis (18), at least in the upper end region remote from the base plate (11). Irrespective of the above, an improved connection between the base plate (11) and a bow-shaped support element (24) for the support (25) is proposed.

18 Claims, 5 Drawing Sheets

U.S. PATENT DOCUMENTS

| | | | | |
|---|---|---|---|---|
| 6,543,793 | B1 * | 4/2003 | Reuss et al. | 280/11.36 |
| 6,631,919 | B1 * | 10/2003 | West et al. | 280/633 |
| 6,729,642 | B1 * | 5/2004 | Gouzes et al. | 280/623 |
| 6,736,413 | B1 * | 5/2004 | Laughlin et al. | 280/14.22 |

FOREIGN PATENT DOCUMENTS

| | | |
|---|---|---|
| JP | 2000093571 | 4/2000 |
| WO | WO 01 49381 | 7/2001 |

* cited by examiner 25
39
63
42
42
49
38
39
43
64
45
50
69
70
66
26
67
68
59
57
1
62
61
66
60
58
44
65
40
46
31
28
36
27
24
18
19
11
2

BINDING MECHANISM FOR SPORTS DEVICES, IN PARTICULAR FOR A SNOWBOARD

BACKGROUND OF THE INVENTION

1. Field of the Invention

The invention relates to a binding mechanism for sports devices, in particular for a snowboard, with a base plate attached to a sports device and for supporting a sports shoe, on which an essentially vertically disposed support element is retained for supporting the rearward collar region or calf region of a sports shoe, and this support element is mounted so as to pivot about a pivot axis extending substantially parallel with the standing plane of the base plate and substantially transversely to the binding longitudinal axis, being limited by stops and a binding mechanism for sports devices, in particular for a snowboard, with a base plate attached to a sports device and for supporting a sports shoe, which has at least one retaining tab at its peripheral regions on either side of its longitudinal axis for retaining a respective leg of a U-shaped or bow-shaped support element and this bow-shaped support element is mounted with or forms a support which pivots to a limited degree in the form of a back support.

2. The Prior Art

Numerous binding mechanisms are known for board-type runner devices which are used on their own, in particular so-called snowboard bindings, and have a base plate by means of which the binding mechanism can be mounted on the snowboard. This base plate more or less corresponds in shape and size to the shoe sole of a correspondingly designed sports shoe. As a rule, this base plate is slightly shorter than the sole length of the sports shoe which has to be attached to and released from it. Extensions project vertically from the standing plane in the lengthways peripheral regions of the base plate. These extensions are preferably integrally formed on the base plate and may be provided as retaining extensions extending continuously in the two peripheral regions or raised at the centre to form a support frame which is U-shaped as seen in plan view. This U-shaped support frame is intended to surround the heel region of the sports shoe and can be individually adjusted and fixed in the lengthwise direction of the binding relative to the base plate in order to be adapted to different shoe sizes. To this end, several mutually spaced orifices for fixing screws or longitudinal slots are provided in the peripheral extensions or in the two legs of the support frame, as described in patent specification EP 1 127 592 A1, for example. This binding mechanism also has a so-called back support, by means of which the user of the binding mechanism is supported in the rearward direction. This back support may be mounted directly on the extensions and pivots about a pivot axis extending transversely to the binding longitudinal axis, limited by stops, or this pivot bearing is provided directly on the U-shaped support frame. The stop restriction for the support in the rearward direction is preferably provided by means of a stop element acting on the support element, which moves so that it bears on the U-shaped support frame, thereby limiting the pivoting motion of the support. Binding mechanisms of this type are usually provided with a strap arrangement and/or with automatic coupling mechanisms to form so-called "step-in" bindings. The disadvantage of these binding mechanisms is that they can be adapted to the individual requirements of the user to a limited degree only.

SUMMARY OF THE INVENTION

The underlying objective of the present invention is to propose a binding mechanism for sports devices, in particular a snowboard binding, which enables the angular position of the back support to be readily adjusted to suit the individual wishes and requirements of different users. Irrespective of this, another objective of the invention is to ensure that the adjustable connection between the base plate and the support element for the back support is more securely prevented from unintentional shifting, using structurally simple means.

One objective of the invention is achieved due to the fact that the support element is made up of at least a first and second support part, disposed one after the other in the direction of the binding longitudinal axis and at least partially overlapping, and an adjusting mechanism for varying a distance between the first support part and the second support part in the direction of the binding longitudinal axis at least in the upper end region remote from the base plate.

One advantage of the snowboard binding proposed by the invention resides in the fact that the multi-part support element can be flexibly adjusted to suit individual wishes of the user and to the prevailing conditions of usage. It is of particular advantage that the adjusting mechanism for varying the distance between the support parts may be provided exclusively on the support element and is not required to co-operate directly with other parts of the binding mechanism, in particular the support frame for the back support. In particular, this adjusting mechanism may be mounted entirely on the support element, so that the rearward region of the binding mechanism close to the ground can be kept substantially free of components needed to set the initial position. The adjusting mechanism for adjusting the distance between the support parts may also be of a relatively strong design and is simple and convenient for the user to operate. In particular, the angular position or initial position of the support element relative to the base plate can be rapidly changed or adapted without difficulty.

Also of advantage is a design of the binding mechanism in which the end portions of the first and second support part are joined to one another by means of a pivot bearing because this enables the pre-set angle of the support element to be varied within a broad range and provides a connection between the support parts capable of withstanding a high degree of strain. The two support parts may also be made as separate components and assembled in a simple manner to form the actual support element.

The design of the binding mechanism in which the support parts are pivotably joined in the end regions lying immediately adjacent to the base plate enables the angular position of the two support parts relative to one another to be adjusted within broader ranges, thereby affording an extensive adjustment range for the pre-set angle of the back support surface on the support element with respect to the standing plane of the base plate.

In one embodiment, the pivot axis of the pivot bearing between the first and the second support part is substantially parallel with the standing plane and affords a connection between the components that is light and will remain serviceable for a long time.

In another embodiment of the binding mechanism, the pivot axis for the entire multi-part support element and the pivot axis between the two support parts are spaced at a distance apart from one another in the vertical direction, providing separate articulation points for the individual support parts and the resultant assembled support element, permitting an efficient adjustment between shoe and binding.

Also of advantage is a design of the binding mechanism in which the pivot axis between the base plate and the support element and the pivot axis between the first and second support part are identical, since this permits a reduction in the number of components required, particularly in terms of pivot pins or pivot bolts.

Also of advantage is a design of the binding mechanism in which the support element is mounted on a bow-shaped support element at a vertical distance from the standing plane, since this keeps the section of the binding mechanism intended to receive the heel region of a sports shoe free so that the rear region of the user's foot is able to lie as flat as possible against the support element.

In one embodiment of the binding mechanism, the pivoting action of the first support part about the pivot axis is restricted to the rear in the direction of the binding longitudinal axis by at least one stop surface, enabling pressure applied by the foot of a user to be transmitted as directly as possible and without delay as a means of controlling the board-type runner device.

A high-strength, structurally simple and hence inexpensive design of the stop for limiting the pivoting action of the support element is obtained due to the fact that the stop surface on the first support part is provided in the form of a rigid projection and abuts with a cooperating surface on the support element.

Another option for setting the initial position of the support element relative to the base plate is obtained by an optional design of the binding mechanism in which the stop surface is provided on a stop element, which is mounted on the first support part and can be adjusted in the vertical direction and fixed.

Also of advantage is an embodiment of the binding mechanism in which the adjusting mechanism has a spacing element between the first and the second support part, which can be displaced into at least two positions, since it enables a defined initial angle of the support element to be set and then released again if necessary.

Of particular advantage is another embodiment of the binding mechanism in which the adjusting mechanism has a lever or cam arrangement which can be pivoted through a dead centre position, since it enables the adjusting mechanism to be forcefully operated and simultaneously secures the adjusting mechanism in at least one of the positions which it can assume, reliably preventing any inadvertent displacement, without requiring any additional manipulations to secure the adjusting mechanism in the desired position.

The advantageous embodiment of the binding mechanism in which the adjusting mechanism enables the pre-defined distance between the first and second support part to be rapidly adjusted and released by shifting the lever or cam arrangement makes operation of the adjusting mechanism rapid and intuitive and makes it easy to see what the current setting it.

Also of particular advantage is the embodiment of the binding mechanism whereby the adjusting mechanism is designed for pre-setting or pre-selecting a desired minimum distance between the first and the second support part on assuming its active position because it enables the respective angular position desired or obtained to be rapidly and easily set and it can also be rapidly and easily reversed or released again if necessary.

Another embodiment of the binding mechanism which offers advantages is one whereby the adjusting mechanism is retained so that it can be displaced in the vertical direction and fixed relative to the support element or on a plane inclined relative to the support surface of the first support part, or the adjusting mechanism co-operates with an oblique surface disposed on the adjacent support part and inclined relative to the rear face or support surface thereof, since this provides a simple means of individually varying the distance between the support parts and the new distance value or extended angle between the support parts can be fixed as an initial set value.

Also of advantage is an embodiment of the binding mechanism in which the adjusting mechanism has a handle enabling displacement relative to the support element without the need for tools, since it enables the predefined minimum distance between the support parts to be effortlessly altered during use of the binding mechanism or during travel in open terrain or in the open countryside.

Of particular advantage is the embodiment of the binding mechanism whereby the adjusting mechanism has a pivotably mounted lever for rapidly setting and releasing an extended angle of the first support part relative to the second support, which forces the support parts into the desired setting or the desired initial setting of the support element, because the lever enables the adjusting mechanism to be forcefully operated. It also makes operation of the binding mechanism more convenient for the user because the initial angle can be altered or adapted without difficulty, even when the sports shoe is fitted in the binding mechanism and retained as far as possible without clearance therein.

Irrespective of the above, the objective is also achieved by the invention due to a binding mechanism in which friction-enhancing surfaces or matching teeth are provided between the legs and the associated retaining tabs and these teeth are designed to enable the support element to be positioned in steps relative to the base plate in the direction of the binding longitudinal axis.

One advantage which this solution affords is that it produces a connection between the base plate and the bow-shaped support element that is capable of withstanding a high degree of strain and counteracts any possibility of this connection inadvertently being released or working loose. In particular, this design enables the minimum fixing torque for the fixing elements to be of a lesser rating than assembly means used to date, but nevertheless connects the components securely and prevents any displacement.

Advantage is to be had from an embodiment of a binding mechanism in which the teeth are connected to the support element so as to be displaceable in the direction of the binding longitudinal axis on a retaining plate, since there is no need for teeth to be provided on the support element itself, which means that one and the same support element may be used for a whole range of binding mechanism types.

In one embodiment of the binding mechanism, the retaining plate can be adjusted and fixed transversely to the binding longitudinal axis with respect to the legs of the support element by means of screw-type fixing elements, or the teeth on the retaining plate can be displaced into and out of positive engagement with the matching teeth on the retaining tabs in several positions in the direction of the binding longitudinal axis, thereby providing a simple means of releasing and preventing the relative displaceability of the support element with respect to the base plate.

Also of advantage is an embodiment of the binding plate in which oblong orifices are provided in the retaining tabs, the length of which determine the longitudinal displaceability of the support element relative to the base plate, because the base plate and support element can be prevented from being totally separated whilst adjusting the relative position of these components.

Finally, advantage is also to be had from the embodiment of the binding mechanism in which the oblong orifices and the fixing elements inserted through them can be covered by a visible cap-type cover element, since this enables a visually attractive appearance to be imparted to the binding mechanism and the screw-type fixing elements are protected from a build-up of snow or ice.

BRIEF DESCRIPTION OF THE DRAWINGS

The invention will be described in more detail below, with reference to the embodiments illustrated as examples in the appended drawings. Of these.

DETAILED DESCRIPTION OF PREFERRED EMBODIMENTS

Figure 1:
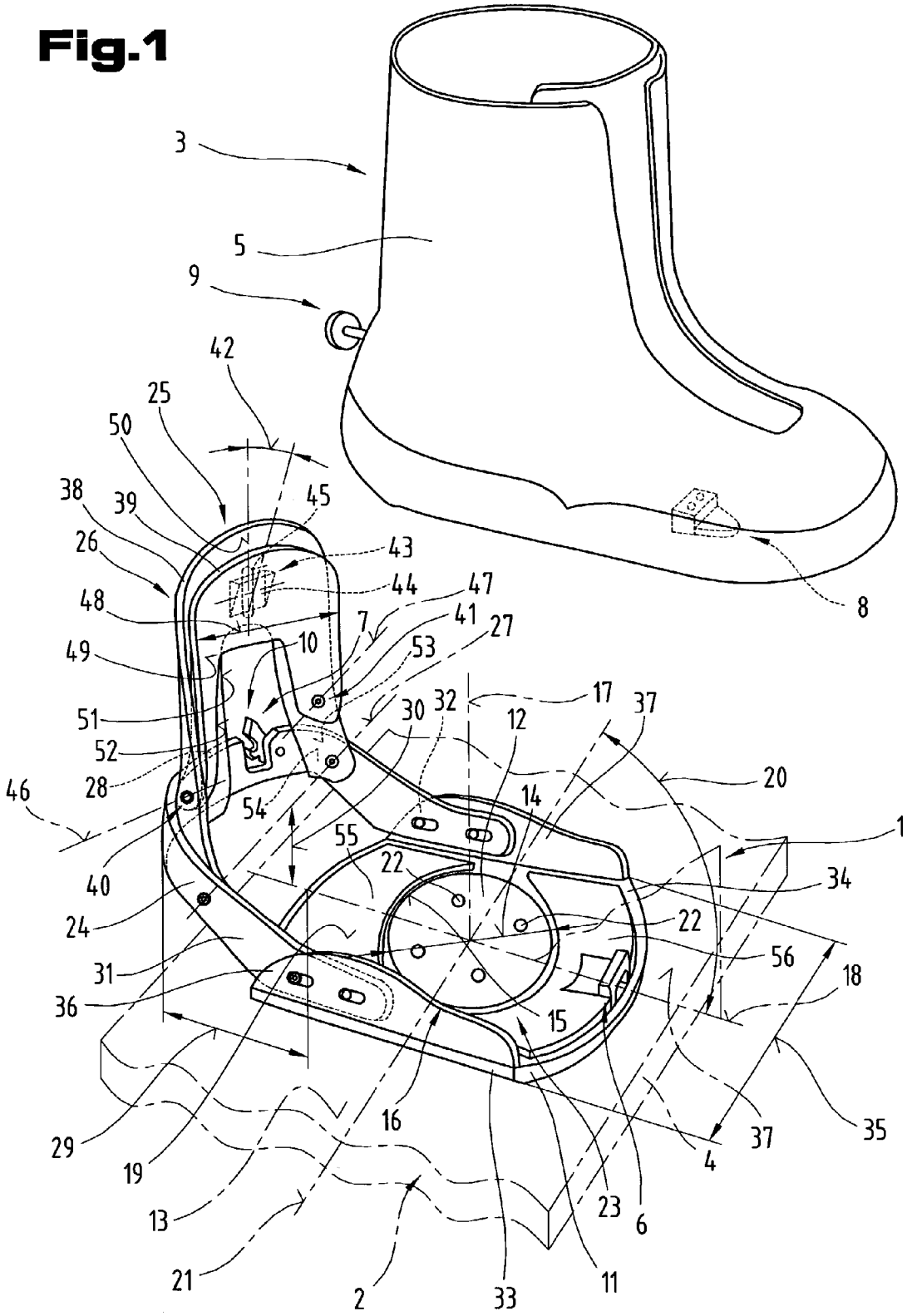
FIG. 1 is a highly simplified perspective diagram of one embodiment of the binding mechanism proposed by the invention.

Firstly, it should be pointed out that the same parts described in the different embodiments are denoted by the same reference numbers and the same component names and disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 shows a perspective view of a binding mechanism 1 for releasably connecting a runner device, in particular a board-type sports device 2, to a sports shoe 3 as necessary. By preference, the sports device 2 is what is known as a snowboard 4, on which the binding mechanism 1 is to be mounted so that it can be releasably connected to a snowboard shoe 5 of an appropriate design.

The binding mechanism 1 has at least one coupling part 6, 7 for establishing a releasable connection as required with at least one matching coupling part 8, 9 on the sports shoe 3. The coupling parts 6, 7, 8, 9 may be a latch coupling 10 or so-called "step-in system" which can be operated without tools, enabling sports shoe 3 and binding mechanism 1 to be comfortably and rapidly connected and released.

The coupling parts 6, 7 of the binding mechanism 1 may be of the type falling within the scope of the invention or alternatively may be provided in the form of at least one strap arrangement known per se. These strap arrangements known from the prior art have at least one strap-shaped tensioning element with a buckle or some other clamping mechanism, by means of which the sports shoe 3 can be securely strapped in the binding mechanism 1 and then released again to dismount from the binding mechanism 1.

The coupling part 9 of the sports shoe 3 may be a bolt-shaped extension in the heel region, for example. The other coupling part 8 on the sports shoe 3 may be a tongue-type retaining extension on the sole, which can be located in a positive engagement with a recess or retaining tab on the binding mechanism 1. The other coupling part 7 of the binding mechanism 1 may be provided in the form of a pivotably mounted hooking element displaceable in conjunction with the heel-side coupling part 9, of a type long since known from the prior art.

The binding mechanism 1 also has a substantially flat base plate 11, which is attached to the top face 13 of the snowboard 4 by means of a retaining plate 12. As seen in plan view, the base plate 11 preferably has a contour that is substantially the same shape as the shoe sole. However, it would also be possible for the base plate 11 to be designed in the form of a beam-shaped support, with coupling elements at its end regions for connecting it to a correspondingly designed shoe.

The retaining plate 12 for securing the base plate 11 and the entire binding mechanism 1 to the snowboard 4 has a circular contour, as seen in plan view. A thickness of the wheel-like retaining plate 12 corresponds more or less to a thickness of the base plate 11. A diameter 14 of the retaining plate 12 may be 70 mm to 140 mm, preferably approximately 105 mm.

In its central region, the base plate 11 has a circular orifice 15 or a corresponding recess, the diameter of which essentially corresponds to the diameter 14 of the retaining plate 12. The retaining plate 12 and the base plate 11 can be at least partially inserted one in the other and connected in a positive fit via the orifice 15 or recess. The circular retaining plate 12 together with the complementary orifice 15 or matching bore forms a lockable and releasable rotary bearing 16 for the base plate 11 relative to the top face 13 of the snowboard 4. In particular, this rotary bearing 16 forms an axis 17 disposed substantially perpendicular to the base plate 11 and the top face 13 of the snowboard 4, extending parallel and congruently with the binding vertical axis.

The base plate 11 preferably conforms to the sole shape of the sports shoe 3 and is asymmetrical relative to a binding longitudinal axis 18. This binding longitudinal axis 18 preferably extends through the centre of the retaining plate 12 and is substantially parallel with a standing plane 19 for the sports shoe 3. The standing plane 19 for the sports shoe 3 on the base plate 11 may extend substantially parallel with the top face 13 of the snowboard 4 or may be disposed at an oblique angle to the top face 13 of the snowboard 4 to produce what is known as a "canting".

The selectively lockable and releasable rotary bearing 16 between the retaining plate 12 and the base plate 11 enables the angle of rotation of the binding mechanism 1 to be set in different positions relative to the snowboard 4. In particular, an angle of rotation 20 between the binding longitudinal axis 18 and a longitudinal axis 21 of the snowboard 4 can be set as desired by the user in a known manner and the desired angle of rotation 20 fixed. In particular, this rotary bearing 16 enables the angle of rotation 20 to be adjusted from the "Regular" to the "Goofy" angle and vice versa. Similarly, this rotary bearing 16 enables the binding longitudinal axis 18 to be changed from a parallel alignment with the longitudinal axis 21 to a position disposed transversely or perpendicular to the longitudinal axis 21. Basically, however, this rotary bearing 16 may be designed so that it can be released and locked without stops so that the angle of rotation 20 can be set in an adjustment range of 360°.

In a known manner, at least two binding mechanisms 1, either identical in design or specially adapted for the right and left foot, are mounted on a snowboard 4. To this end, it is usually necessary to provide a plurality of fixing screws 22, which extend through the retaining plate 12 and can be anchored in the snowboard 4 in order to secure the binding mechanism 1 to the top face 13. In the designs known from the prior art, the fixing screws 22 also fulfil the function of an adjusting and fixing mechanism 23 for the angle of rotation 20 and the rotary bearing 16.

The binding mechanism 1 also has a support element 24, which is U-shaped or bow-shaped as seen in plan view, for a support 25 which extends essentially perpendicular to the base plate 11. This support 25 is preferably a flat element with a cambered cross section and is intended to support the calf region of a user and the rear region of the sports shoe 3. Generally speaking, the support 25 is therefore also referred to as back support 26 or so-called "high-back".

The support 25 and the associated back support 26 is preferably able to pivot to a limited degree via a pivot axis 27 extending substantially transversely to the binding longitudinal axis 18 and substantially parallel with the standing surface 19 of the base plate 11. In particular, a pivoting action of the support 25 is restricted in a direction opposite the base plate 11 to the rear, preferably by means of an individually adjustable stop element—not illustrated. The supporting action of the support 25 and the introduction of force or force transmission between the user and the sports device 2 can be optimally adjusted to individual needs and different requirements.

In order to minimise space requirement, the support 25 which essentially stands up vertically from the standing plane 19 of the base plate 11 during use can be switched—in a known manner—to a collapsed or folded position, in which the support 25 assumes a space-saving position, making the sports device 2 easier to transport.

The support 25 is mounted or retained so as to transmit load and forces to the bow-shaped support element 24. The support 25 is mounted in the region of a base 28 and in the base section of the U- or bow-shaped support element 24.

The base 28 or the base section of the support element 24 preferably sits at a distance 29 behind the rearmost point of the base plate 11 by reference to the binding longitudinal axis 18 and on the binding mechanism 1 during normal use. In other words, the support element 24 usually projects above the rearmost point of the base plate 11 and in doing so bears the support 25 at a vertical distance 30 above the standing plane 19. The two legs 31, 32 of the bow-shaped support element 24 extend along the base plate 11 at the lengthwise peripheral regions 33, 34. A distance between the two substantially mutually parallel legs 31, 32 thus corresponds more or less to a width 35 of the base plate 11 and essentially the width of a special sports shoe 3 with which it is used.

The bow-shaped support element 24 with the two legs 31, 32 and the base 28 connecting them is preferably made in a single piece and is made from a high-strength material, such as metal for example. Similarly, the support element 24 may be made from a high-strength plastics or from a light metal, such as aluminium for example.

The support element 24 may be connected to the base plate 11 so that it can be removed or released if necessary—as schematically illustrated. To this end, retaining tabs 36, 37 are provided in the peripheral regions 33, 34 of the base plate 11 for fixing the bow-shaped support element 24. These retaining tabs 36, 37 are preferably made integrally with the base plate 11 and stand proud in a substantially vertical arrangement from the standing plane 19 thereof.

Still within the scope of the invention, it would naturally also be possible to provide a bow-shaped support element 24 made integrally with the base plate 11.

The support 25 is preferably mounted on the bow-shaped support element 24 so that it can pivot to a limited degree. Alternatively, it would also be possible for the support 25 to be mounted directly on the base plate 11, in particular on the retaining tabs 36, 37 thereof. To this end, the two lateral mounting arms of the support merely need to be lengthened and directly connected to the retaining tabs 36, 37 so as to pivot on the base plate 11. This being the case, these lengthened mounting arms of the support 25 may also be provided with the stop surfaces to limit the rearward pivoting action of the support 25 in the direction of the binding longitudinal axis 18, i.e. starting from the bearing region for the balls of the feet in the direction towards the heel standing region of the base plate 11.

The key factor is that the support 25 or the back support 26 is made from at least two parts and consists of a first and a second support part 38, 39. The first support part 38 and the second support part 39 co-operating with the first support part 38 are thus arranged one behind the other in the direction of the binding longitudinal axis 18 and are congruent and overlap by reference to a vertical transverse plane indicated by a broken line, at least partially or in certain sections.

The first support part 38 and the second support part 39 are preferably joined to one another at their end portions disposed immediately adjacent to the base plate 11. This connection is preferably provided in the form of a pivot bearing 40, 41 between the first and the second support part 38, 39, which enables the first support part 38 and the second support part 39 to pivot relative to one another. This pivot bearing 40, 41 therefore enables a distance 42 or an angular position between the first support part 38 and the support part 39 to be varied.

The pivot bearing 40, 41 may provide a positive connection between the first and the second support part 38, 39 or alternatively may be provided as what is known as a film hinge between these two parts.

The pivot bearing 40, 41 is preferably provided in the form of a screw or bolt connection between the two support parts 38, 39. The key point is that the angular position of the second flat support element 39 can be adjusted relative to the standing plane 19 and a V-position between the two support parts 38, 39 varied, and the desired distance 42 between the two support parts 38, 39 fixed in at least one direction, i.e. at least a minimum distance is defined between the two support parts 38, 39. An adjusting mechanism 43 is provided for this purpose, by means of which at least the minimum distance 42 or a minimum possible pivot angle can be individually set and fixed between the two support parts 38, 39. In particular, this adjusting mechanism may be used to fix the smallest possible extension or a minimum possible angle of extension between the first support part 38 and the second support part 39.

The adjusting mechanism 43 may optionally also be designed so that the set distance 42 or angle of extension between the first and the second support part 38, 39 is fixed in both directions, i.e. it can be neither reduced nor increased.

In the most basic situation, this adjusting mechanism 43 is provided in the form of a spacing element 44 disposed between the first and the second support part 38, 39. In order to set different distances 42, this spacing element 44 may be shifted in a vertical direction, in particular perpendicular to the pivot axes of the pivot bearing 40, 41, into different positions and fixed. This being the case, the farther this spacing element 44 is moved in the direction towards the pivot bearing 40, 41, the greater the extension between the first and second support part 38, 39, whereas the farther the spacing element 44 is moved away from the pivot bearing 40, 41 the more reduced the limit value of the angle of extension angle between the first and the second support part 38, 39 is.

In order to change and fix the height position of the spacing element 44, a guide mechanism 45 may be provided on the first or the second support part 38, 39, by means of which the height of the spacing element 44 relative to the base plate 11 can be adjusted and fixedly connected in the desired position with the first or the second support part 38, 39. The spacing element 44 used to fix the desired relative position with respect to the first or the second support element 38, 39 may be a screw or nut arrangement. Optionally, this screw or nut arrangement may be provided with a handle—not illustrated—thus enabling the spacing element 44 to be adjusted and fixed without the need for tools.

To enable different angular positions or an initial angle to be set between the support element 25 and between the second or front support element 39 and the standing plane 19, the spacing element 44 of the adjusting mechanism 43 can be displaced into at least two different positions. The adjusting mechanism 43 is therefore at least designed so that the user can choose individually between at least a first and a second initial angle of the support 25 and the second, flat support part 39 relative to the base plate 11. A simple and rapid adjustment can therefore be made to suit the prevailing conditions or requirements of the user. The spacing element 44 may also be mounted so that it can rotate, so that different spacing widths or support heights can be obtained between the two support elements 38, 39 depending on the angular position relative to the rear face of the support 25. This rotatably mounted spacing element 44 may therefore have steps of differing heights or an inclined support surface for steplessly adjusting the distance 42 or the spacing width.

The spacing element 44 may therefore be of a block- or wedge-shaped design to provide large enough counter or abutment surfaces between the support parts 38, 39, thereby imparting to the adjusting mechanism 43 a design that is as capable as possible of withstanding loads and resistant to breaking.

The pivot bearing 40, 41 between the first or rearward support part 38 and the second or forward-mounted support part 39 forms at least one pivot axis 46, 47 substantially parallel with the standing plane 19. By preference, the pivot axes 46, 47 are congruent with one another, i.e. the pivot axes 46, 47 are aligned flush with one another. However, it would also be possible for the pivot axes 46, 47 between the first and the second support part 38, 39 to be oriented slightly differently and extend at an angle relative to one another. Due to the fact that there is a certain flexibility and/or a defined compensating clearance between the support parts 38, 39, which are preferably made from plastics, it is nevertheless possible to obtain a sufficient degree of pivoting motion between the parts connected in this manner. The same applies to the pivot axis 27 between the support 25 combined accordingly or between the first support part 38 and the base plate 11, in particular with respect to the support element 24 thereof.

The optionally provided pivot axis 27 for the common pivoting action of the multi-part support 25 relative to the base plate 11 and the pivot axes 46, 47 between the two support parts 38, 39 are preferably spaced apart from one another in the vertical direction, as schematically indicated. Alternatively, however, it would also be possible for the pivot axis 27 between the base plate 11 and the support 25 and the pivot axes 46, 47 between the first and the second support part 38, 39 to be identical, i.e. forming one and the same pivot point. In particular, the pivot bearing 40, 41 for varying an angle of extension between the support parts 38, 39 may be guided directly, together with the pivot bearing forming the pivot axis 27 for the common pivoting action of the support 25 relative to the base plate 11. This will save on bearing components, such as pivot bolts, for example.

Especially the rearward or back support part 38 may also be provided in the form of a relatively slim support pillar, the extension of which parallel-with the width 35 of the base plate may be significantly shorter than a width 48 of the flat support part 39 mounted in front. In other words, a support surface 49 of the second or front support part 39 may, for practical purposes, be larger than an effective support surface 50 of the support part 38 to the rear or mounted behind by reference to the binding longitudinal axis 18. In particular, the first support part 38 may also be provided in the form of a support pillar standing up from the base plate 11 in a substantially vertical arrangement, which acts as a thrust or counter bearing for the flat support part 39 mounted in front.

It has been found to be particularly practical to mount the adjusting mechanism 43 on the first support part 38 or on the support pillar provided thereby and adjust the desired distance 42 in the top end region between the first and the second support part 38, 39 via the spacing element 44 lying in between.

By reference to a transverse plane perpendicular to the binding longitudinal axis 18, the two support parts 38, 39 are congruent or overlap in broad regions. The overlap between the two support parts 38, 39 may in effect be more than 50% of the projection surface of the support part 38, 39 having the smaller surface.

The multi-part support 25 is primarily used in conjunction with the adjusting mechanism 43 to determine or set an initial position or an initial angle of the foot of a user relative to the standing plane 19 or relative to the base plate 11. In a generally known manner, the way force is transmitted from the leg or foot of a user to the sports device 2, in particular the control edges thereof, will depend on the selected initial angle of the support 25 or so-called "high-back" relative to the base plate 11.

At least one orifice 51 and/or cut 52 may be provided in the first and/or the second support part 38, 39 as a means of reducing the material required for the support 25 without significantly impairing its strength. By preference, peripheral slits 52 are provided in the longitudinal mid-region of the support 25 to enable the sports shoe 3 to be effortlessly brought into and out of engagement with coupling part 7 retained on the support element 24, which is preferably provided in the form of a catch coupling 10 or a claw coupling.

The limited capacity of the support 25 to pivot rearwards in the direction of the binding longitudinal axis 18 is achieved in a simple manner due to the fact that the first or rearward support part 38 has at least one stop surface 53, which, when the end of the possible pivot path to the rear is reached, either comes into abutment directly with the base plate 11 or, as schematically illustrated, with the support element 24 thereof. In order to obtain a strong end stop for the support or the rearward support part 38, several or extensive stop surfaces 53 are provided on the support part 38. Consequently, the forces which occur at the end stop, which is preferably formed by the bow-shaped support element 24, can be absorbed reliably and in the most stable manner possible. The first or rearward support part 38 is provided with the stop surface 53 which preferably bears on a counter surface 54 provided on the support element 24 anyway. Consequently, the stop restriction for the entire support in the rearward direction or in a direction pivoting away from the base plate 11 is very simple to provide. The counter surface 54 may be defined by the upper slim face or by the inwardly lying broad face of the bow-shaped support element 24, which is preferably provided in the form of a flat bar.

An advantage primarily afforded by the multi-part support 25 with the adjusting mechanism 43 described above is that it is basically no longer necessary for the stop surface 53 on the support 25 or the counter surface 54 on the support element 24 to be displaceable relative to one another in order to obtain different initial positions or initial angles of the support 25 relative to the base plate 11. In particular, the stop surface 53 and the counter surface 54 may also be designed in a rigid or predefined manner, yet still allow the initial angle to be individually selected via the adjusting mechanism 43 of the multi-part support 25. Amongst other things, this is of particular advantage with the binding mechanism 1 illustrated here since, because of the catch coupling 10 provided at the centre of the support element 24, it has been necessary until now to provide two separate positioning elements, usually disposed symmetrically relative to the binding longitudinal axis 18, in order to make individual adjustments to the initial angle. However, the multi-part support 25 with the adjusting mechanism 43 is not restricted to the use of this type of binding mechanism 1 and instead this embodiment may advantageously also be used with other types of binding mechanisms 1 which have a different type of coupling mechanism. In particular, any generic type of binding mechanism 1 can now be provided with the system of rapidly adjusting and re-adjusting the initial angle of the support 25 and benefit from its high strength.

The fixed stop surface 53 may be provided as a strip-shaped projection integrally formed on the rearward support part 38, for example, which moves in a more or less vertical direction from above into to abutment with the bow-shaped support element 24 when the support 25 is fully pivoted backwards.

Alternatively, the adjusting mechanism 43 and the spacing element 44 may also be provided by means of a screw with a relatively coarse thread, which is screwed into the rearward support part 38 and by means of which the distance 42 or space between the support parts 38, 39 can be varied depending on the screw-in depth.

However, the adjusting mechanism 43 may also be provided as a spacing element 44 which is slidable transversely to the binding vertical axis. Alternatively, the adjusting mechanism 43 may be provided in the form of a push-button or a clasp.

At least one seating element 55, 56 forming the standing plane 19 may also be provided on the base plate 11. This being the case, this at least one seating element 55, 56 may be provided in the form of a damping element to enhance the static friction of the binding mechanism 1 with sports shoe 3 or an element made from expanded foam or an elastomer in the form of a so-called padding and/or by a seating element 56 in the form of a so-called pedal extending the base plate 11. A pedal of this type is preferably provided at the front end region of the base plate 11 by reference to the binding longitudinal axis 18 and acts as a support for the region of the balls of the feet or toes in the sports shoe 3 and usually lengthens the base plate 11. Depending on the circumstances, this seating element 56 may also be used to obtain a slightly inclined position, in particular a slight rise in the standing plane 19 in the end region of the base plate 11 assigned to the toes of a user, in which case this seating element 56 is usually known as a gas pedal.

Figure 2:
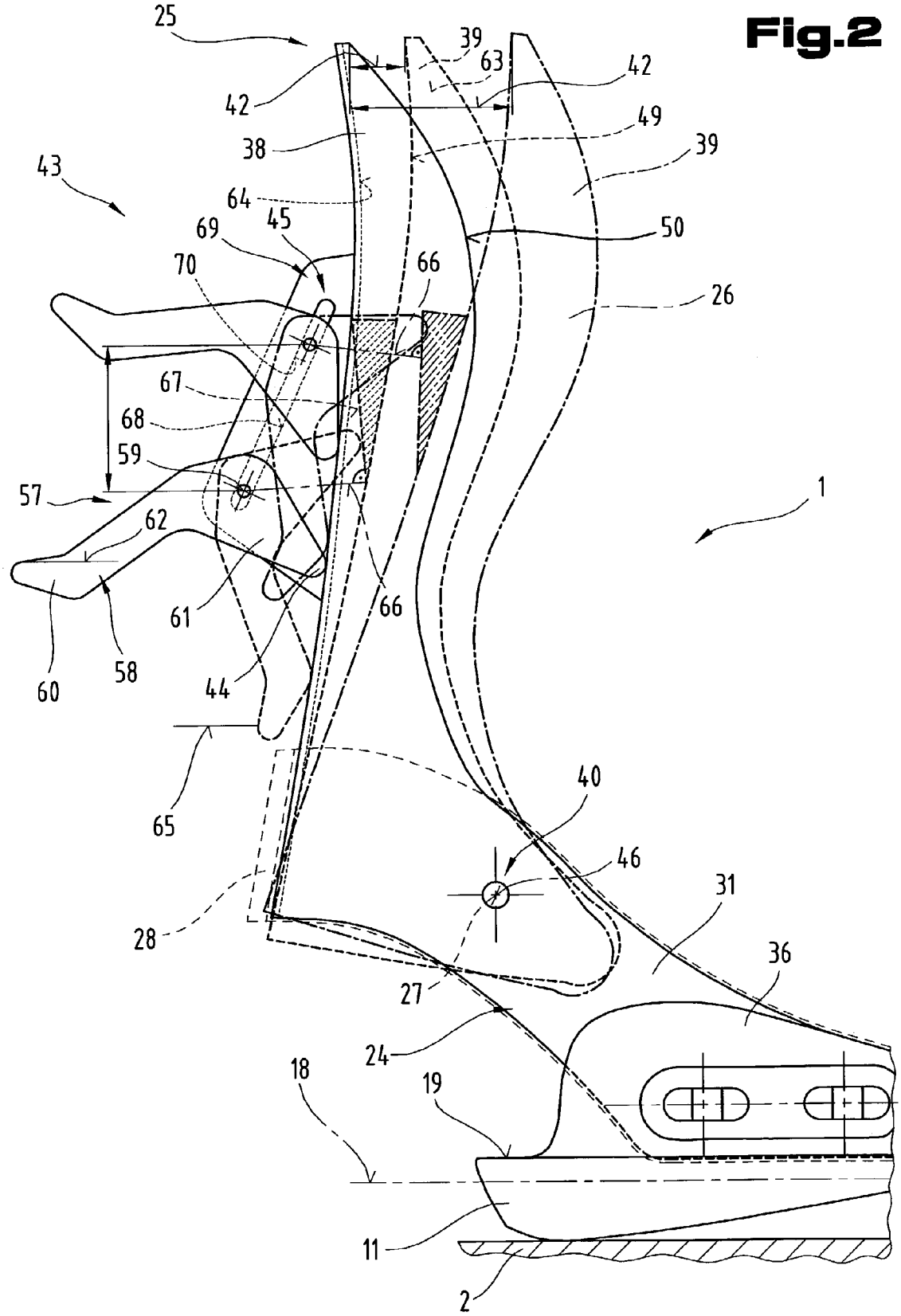
FIG. 2 is a highly simplified, schematic diagram showing a side view of another embodiment of the binding mechanism proposed by the invention with a different design of adjusting mechanism for varying the initial position or angular position of the back support.

FIG. 2 illustrates another embodiment of a ski binding 1 of the generic type with a multi-part support 25 and the adjusting mechanism 43. The same reference numbers are used for the parts already described above and the relevant parts of the description may be applied to identical parts with identical reference numbers.

In this embodiment, support part 38 to the rear in the direction of the binding longitudinal axis 18 is provided on the base plate 11 so as to be rigid or fixed relative to the standing plane 19. In particular, the support element 24 is of an integral design, merging into the support part 38 disposed perpendicular to the standing plane 19. This integrally formed support part 38 with the side legs 31 for connecting to the retaining tabs 36 on the base plate 11 is preferably made from plastics or fibre-reinforced plastics. The support element 24 and the support part 38 may therefore be made as a single, injection-moulded or cast component—as schematically illustrated.

However, as indicated by broken lines, it would naturally also be possible for the. support element 24 to be provided as a separate bow-shaped component, on which a separate support part 38 is mounted so as to pivot to a limited degree about the pivot axis 27, primarily in the direction of the binding longitudinal axis 18.

The adjusting mechanism 43 for adjusting a specific distance 42 between the rearward support part 38 and the support art 39 to the fore by reference to the binding longitudinal axis 18, if necessary, is provided in the form of a lever or cam arrangement 57 in this instance. This lever or cam arrangement 57 has a lever 58 or alternatively a cam or any other eccentric element, which can be shifted into at least two settings or positions. Accordingly, the lever 58 or a corresponding cam is mounted so as to pivot about an axis 59 and is preferably disposed on the rear wall surface of the rearward support part 38. The lever 58 forms an operating arm 60 on one side of the axis 59 and a lever arm 81 on the other side of the axis 59. This lever arm 61 is equivalent to the spacing element 44 described above. By preference, the operating arm 60 manipulated by the user of the binding mechanism 1 is longer than the lever arm 61 provided as a stop on or a means of spacing the second support part 39. Consequently, relatively little operating force has to be exerted on the lever 58 by the user in order to be able to operate the adjusting mechanism.

By preference, the lever 58 is a so-called elbow joint in which the operating arm 60 and the lever arm 61 extend at an angle to one another. The axis of the lever 58 or eccentric cam preferably extends transversely to the binding longitudinal axis 18 and essentially parallel with the standing plane 19.

When the lever 58 is in the non-operating position indicated by a solid line, the spacing element 44 or lever arm 61 is inactive. In other words, in this non-operating position 62, the spacing element 44 does not have any effect between the first support part 38 and the second support part 39. This being the case, the second support part 39 sits against the first support part 38, as far as possible without any clearance or gap. In particular, the two support parts 38, 39 may directly abut with one another, thereby constituting a virtually single, two-layered support 25. Specifically, a rear face 63 of the second support part 39 abuts with or sits against an internal face 64 or support surface of the first support part 38 as far as possible by its full surface. Above all, a distance 42 or extension between the first support part 38 and the second support part 39 is relatively small or almost zero when the lever or cam arrangement 57 is in the non-operating position 62. In this non-operating position 62, the lever 58 preferably assumes a position in which it is folded out or projecting out from the support.

When the lever or cam arrangement 57 is in the active position 65, the lever 58, in particular its operating arm 60, is preferably shifted into a position lying immediately adjacent to the support 25. When the adjusting mechanism 43 is in the active position 65, the operating arm 60 specifically extends substantially parallel with the rear face of the support part 38 and preferably sits thereon, at least in certain portions. The active position 65 of the lever or cam arrangement 57 is indicated by broken lines. In this active position 65, the operating arm 60 is preferably pivoted downwards and the lever arm 61 or the corresponding spacing element 44 is brought into play as a result, and forcibly pushes the second support part 39 away from the first support part 38 so that a defined distance 42 or a specific extension is set between these parts. Consequently, when the lever or cam arrangement 57 is in the active position, the lever arm 61 or the corresponding spacing element 44 therefore spaces the second support element 39 apart from the first support element 38 by pivoting the second support element 39 about the pivot axis 40 and fixes it in this position relative to the first support part 38 at a specific angle of extension.

The defined distance 42 between the support parts 38, 39 is preferably fixed by means of a lever or cam arrangement 57, which can be displaced beyond a dead centre position 66. As a result of this defined dead centre position 66 within the pivoting range of the lever 58, the lever can be relied on to stay in one of the two positions. By preference, the lever 58 is secured in its active position 65 via the defined dead centre within its possible pivot path. Accordingly, when the lever 58 is shifted into the active position 65 indicated by broken lines, the lever 58 remains secured in the active position 65 after it has moved past the dead centre position 66 of the lever arm 61 or corresponding spacing element 44, making it necessary to apply a greater force in order to move the lever 58 in the opposite direction beyond the dead centre position 66 again into the non-operating position 62 indicated by solid lines.

The defined dead centre position 66 for the lever or cam arrangement 57 constitutes a simple and reliable means of securing at least one position, in particular the active position 65, of the adjusting mechanism 43. Designed accordingly, the adjusting mechanism 43 therefore enables a predefined distance 42 or a specific extension between the first and the second support part 38, 39 to be set and released particularly rapidly and with total convenience because there is no need for tools.

The terminal side end of the lever arm 61 or corresponding spacing element 44 is preferably rounded, enabling it to slide over the rear face 63 of the second support 39 with as little resistance as possible. As an option, it would also be possible to provide the end region of the lever arm 61 with rollers or rolls in order to reduce the friction occurring during operation of the lever or cam arrangement 57 to a rolling friction.

Optionally, an oblique surface 67 may be provided on the rear face 63 of the second support part 39 that is inclined relative to the internal or support surface 49 thereof or relative to the rear face 63 thereof. The adjusting mechanism 43 and the lever or cam arrangement 47 co-operate with this inclined oblique surface 67 disposed on the adjacent support part 39. Especially when the lever or cam arrangement 57 is in the active position 65, the lever arm 61 or the spacing element 44 sits against this oblique surface 67. The maximum achievable distance 42 is improved or enlarged as a result of this oblique surface 67 on the rear face 63 of the support part 39 and/or the requisite pivot angle of the lever 58 between the non-operating position 62 and the active position 65 is optimised. In particular, the position of the dead centre position 66 of the lever 58 can be influenced by means of this oblique surface 67.

In another optional and advantageous embodiment, the adjusting mechanism 43 and the lever or cam arrangement 57 can be displaced in the vertical direction relative to the support 25, in particular relative to the rearward support part 38, and fixed. As a result of the adjustability of the adjusting mechanism 43 in the direction perpendicular to the standing plane 19 relative to the support 25, a desired minimum distance 42 can be pre-set or pre-selected between the first and the second support part 38, 39 when the lever or cam arrangement 57 assumes the active position 65. In particular, the possible distance 42 or the corresponding extension between the support parts 38, 39 can be pre-set depending on the height position of the entire adjusting mechanism or the entire lever or cam arrangement 57 relative to the standing plane 19 and relative to the support 25. When the lever or cam arrangement 57 is shifted into the active position 65, the pre-selected distance 42 or the pre-set extension between the support parts 38, 39 is forcibly activated. When the lever 58 of the lever or cam arrangement 57 is pivoted back into the non-operating position 62, the distance 42 or corresponding extension can be reversed.

In terms of the maximum possible adjustment range for the distance 42, it has proved to be effective if the adjusting mechanism 43 or the lever or cam arrangement 57 is displaceably retained on a plane 68 that is inclined relative to the support surface 50 or relative to the internal face or rear face of the first support part 38. In particular, the rear face of the support part 38 may be provided as a bearing block 69, by means of which the lever or cam arrangement 57 can be mounted so as to be displaceable in a direction perpendicular to the standing plane 19 of the base plate 11 and fixable relative to the support 25, in particular relative to the support part 38. The axis 59 of the lever 58 may specifically be received in a guide 70 inclined at an angle to the vertical and fixed at different height positions in this guide 70. The minimum possible distance 42 between the two support parts 38, 39 can be varied or individually set, depending on the height position of the lever or cam arrangement 57 and the axis 59 of the lever 58.

In the embodiment illustrated as an example here, the pre-selected minimum distance 42 between the support parts 38, 39 becomes greater, the higher the adjusting mechanism or cam arrangement 47 is positioned away from the standing plane 19. When the adjusting mechanism 43 is in the positions indicated by the dotted-dashed lines, the distance 42 which can be achieved between the support parts 38, 39 is greater than when the lever or cam arrangement 57 is in the comparatively lower position indicated by broken lines. As the plane 68 or guide 70 extends upwards from the standing plane 19 in the vertical direction, it runs increasingly towards the internal face 64 of the first support part 38. The oblique surface 67 on the other support part 39 extends upwards from the standing plane 19 in a vertical direction, preferably also in a direction towards the internal surface 64 of the support part 38. In particular, the oblique surface 67 and the angled plane 68 on the bearing block 69 extend upwards from the standing plane 19 in the vertical direction and converge with one another or run towards one another.

As indicated by broken lines, the rearward or stationary support part 38 may also be of smaller dimensions than the support part 30 mounted to the fore in the binding longitudinal direction 18.

As may also be clearly seen from this diagram, as the adjusting mechanism 43 or lever or cam arrangement 57 is transferred into the active position 65, the two support parts 38, 39 are forcibly prised apart from one another, thereby forcibly obtaining the angular position or distance 42 between these two parts by operating the levers 58. In particular, the desired initial angle of the support 25 and the support part 39 can also be adjusted under load, e.g. starting from the foot of a user. Above all, even when the binding mechanism 1 is being used and a sports shoe is secured therein with the least possible clearance, the desired initial angle of the support 25 or so-called "high-back" can be adjusted or varied. The user need effortlessly exert only a small amount of force to obtain this new position or adjustment of the initial angle, without having to take the foot out of the binding mechanism 1. This embodiment is therefore more convenient in use.

A support part 39 that can be pivoted out or spaced apart from the support part 38 that is stationary or restricted by a stop in its pivoting action can be released into the pivoted in or pivoted back position when the lever or cam arrangement 57 assumes the non-operating position 62. This releasing motion is preferably effected by a foot of the user exerting pressure on the binding mechanism backwards in the direction of the binding longitudinal axis 18.

Another option is to provide a force storing element, in particular a spring means, between the first and the second support part 38, 39, which constantly pushes the two support parts 38, 39 with a specific force into a position of close mutual abutment. It would also be possible to provide a spring means of this type between the support element 24 and the support part 39, designed so that the support part 39 is continuously forced towards the support part 38 by a specific biassing force.

By contrast with the embodiments illustrated, it would naturally also be possible for the adjusting mechanism 43 to be arranged or retained on the second support part 39 lying immediately adjacent to the foot of a user.

Figure 3:
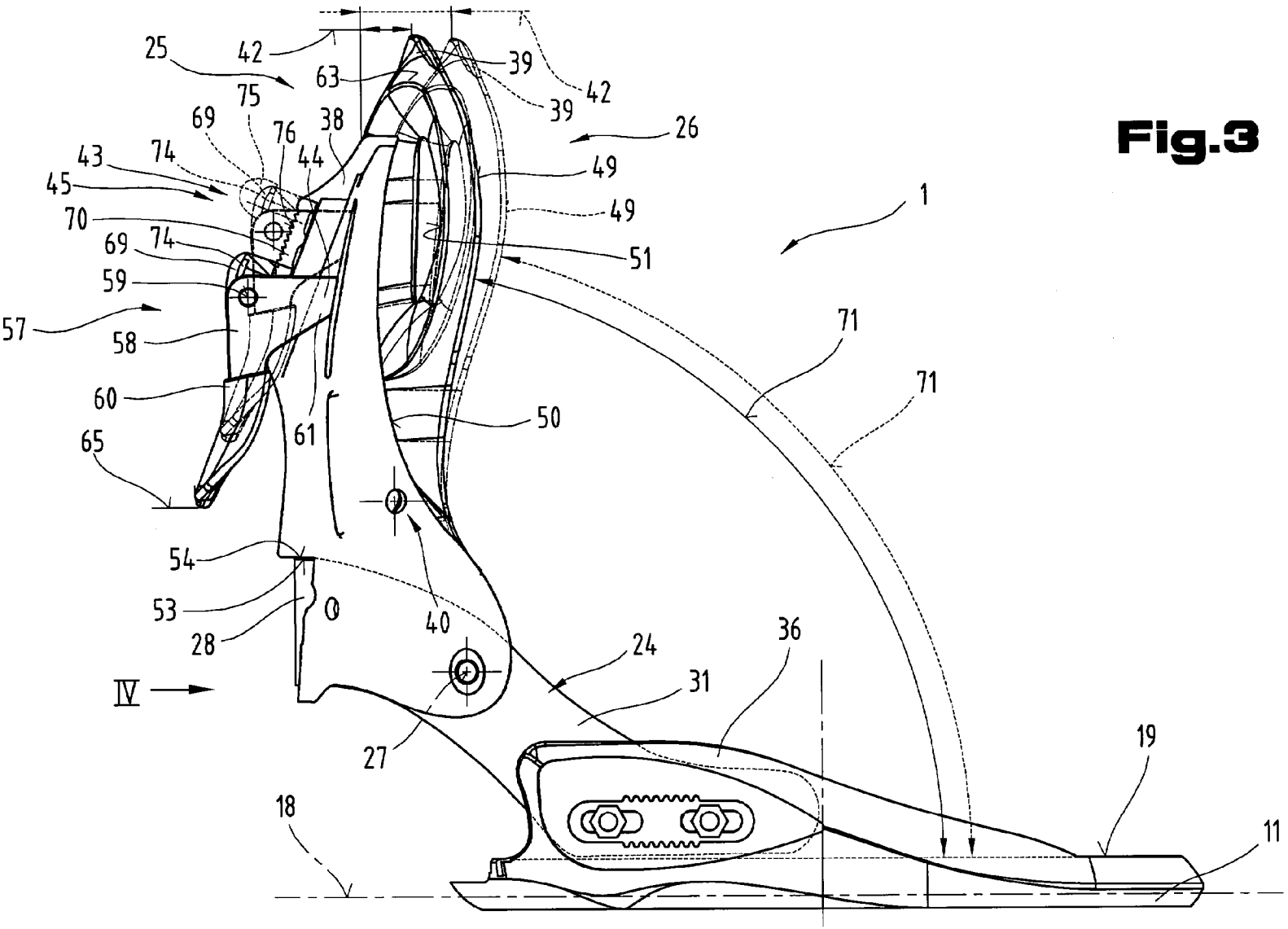
FIG. 3 is a side view highlighting one possible detail of the binding mechanism illustrated in FIG. 2.
Figure 4:
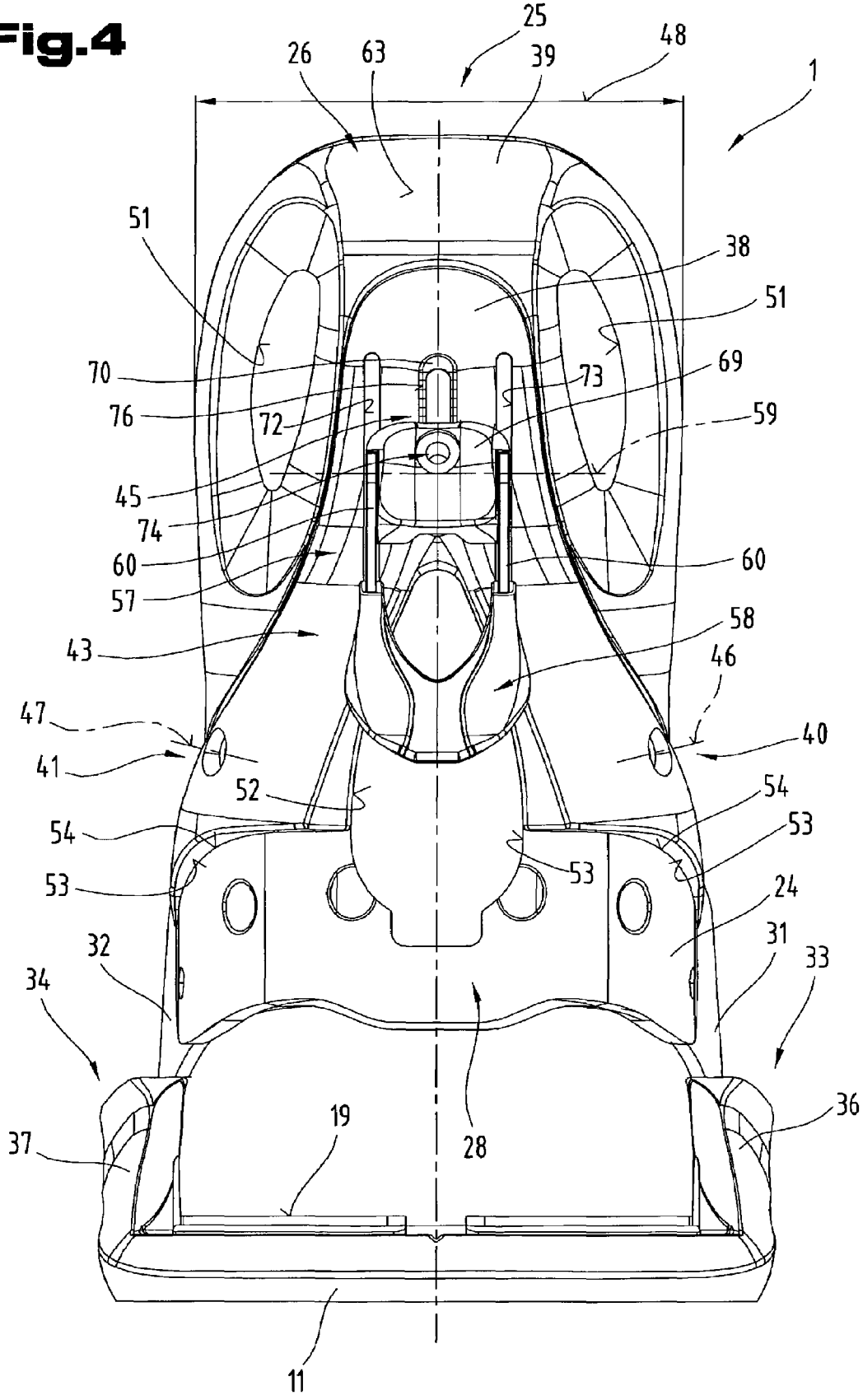
FIG. 4 is an end-on view of the binding mechanism illustrated in FIG. 3, seen from the rear.

FIGS. 3 and 4 illustrate a detail of one particular feature of the embodiment illustrated in FIG. 2. The same reference numbers are used for parts already described above and the relevant parts of the description may be applied to parts denoted by the same reference numbers.

Here again, the binding mechanism 1 has a base plate 11 for mounting on a board-type runner device, on the rearward end region of which the support 25 is provided as a back support 26 which can be variably adjusted in its angular position 71 relative to the standing plane 19. The support 25 is preferably connected via the support element 24 to the base plate 11, in particular to the peripheral retaining tabs 36 thereof. The support 25 is also disposed in a substantially perpendicular arrangement relative to the base plate 11, the support element 24 serving as a connection extending at an incline between the support 25 and the base plate 11.

The support 25 can be pivoted as a whole about the pivot axis 27 on the support element 24 and is restricted to the rear in its pivoting action by a stop surface 53 provided on the support 25 or on the rearward support part 38. The stop surface 53 is preferably provided in the form of a rigid projection on the support part 38, which comes into abutment with the counter surface 54 on the support element 24 when the support 25 is fully pivoted backwards and thus sits in one of the end regions of the restricted pivot path. The counter surface 54 is preferably the upper slim end of the U- or bow-shaped support element 24 as seen in plan view. The key factor is that there is basically no need for the stop element to be displaceable in terms of its position relative to the support 25 or the support element 24 in order to obtain individually adjustable angular positions 71. Instead, the support 25 is advantageously made up of two parts and the distance 42 between the support parts 38, 39 can be variably fixed via the adjusting mechanism 43, at least in the upper end region remote from the base plate 11. Likewise, the distance 42 between the support parts 38, 39 can be varied via the adjusting mechanism 43 by means of parallel guides or angled oblique surfaces, thereby enabling the respective desired angular position 71 to be set or the initial position to be set.

The adjusting mechanism 43 is preferably provided in the form of the lever or cam arrangement 57 described above, which forcibly produces a minimum distance 42 between the two support parts 38, 39 or enables the distance 42 or extension between the support parts 38, 39 to be reduced to virtually zero.

The pivotably mounted lever 58 with two parallel-acting lever arms 61 or the corresponding spacing elements 44 are disposed on the rearward support part 38. In particular, two mutually spaced lever arms 61 (only one lever arm 61 is visible) are provided in a symmetrical layout relative to the longitudinal mid-axis of the support 25 or in a symmetrical layout relative to the binding vertical axis, which force or forcibly prise the support part 39 from the support part 38. The advantage of this is that the force transmission between the two support parts 38, 39 is improved and can be more broadly distributed, thereby affording an altogether stronger adjusting mechanism 43. The two lever arms 61 extend through slot-shaped orifices 72, 73 in the rearward support part 38 and force the support part 39 mounted to the fore apart from the rearward support part 38 when the lever 58 assumes the active position 65 indicated by solid lines.

In the active position 65 indicated by solid lines, therefore, a predefined distance 42 is set between the support part 38 and the support part 39. Optionally, this predefined distance 42 may also be changed by changing the relative position of the adjusting mechanism 43 and the entire lever or cam arrangement 57 relative to the support element 38. In particular, by displacing the lever or cam arrangement 57 upwards in a vertical direction, the minimum possible distance 42 between the support part 38 and the support part 39 mounted to the fore can be increased, as indicated by broken lines. As a result of adjusting the height of the adjusting mechanism 43 in this way, the angular position 71 between the support surface 49 on the support element 39 can be adjusted for the rear region of the foot of the user and the standing plane 19. In particular, the angle subtended by the support part 39 and the base plate 11 can be made smaller and made larger.

The height position of the lever or cam arrangement 57 relative to the standing plane 19 can be adjusted by means of a fixing means 74, which can be released and fixed as necessary, for example in the form of a screw. This fixing means 74 is provided as a means of fixing and slidably retaining the bearing block 69 relative to the support part 38. In particular, the fixing means 74 can be loosened or tightened with an appropriate tool so that the lever or cam arrangement 57 can be displaced on the support 25 along the guide 70 and into the new position defining another possible minimum distance 42 and then fixed.

Optionally, the fixing means 74 may also be provided with a handle 75, for example in the form of a flap or a pivot lever, to enable the fixing means 74 to be readily operated by hand. This will specifically enable the predefined minimum distance 42 or minimum angle of extension between the support parts 38, 39 to be changed without tools when the lever or cam arrangement 57 is active. In order to keep the operating or turning torque which needs to be applied to the fixing means 74 as low as possible whilst nevertheless ensuring that the lever or cam arrangement 57 is securely fixed relative to the support 25, friction-enhancing and/or positively engaging surfaces may be provided between the bearing block 69 and the support 25. These surfaces might be provided in the form of parts made from synthetic material or inserts made from synthetic material with high coefficients of friction, for example rubber or any other elastomer or—as schematically illustrated—in the form of teeth 76 between the bearing block 69 and a rearward surface of the support part 38. As a result of these teeth or by providing friction enhancing counter-surfaces, the lever or cam arrangement 57 need be pressed against the rear face of the support part 38 with relatively low biassing force only, yet still ensures that the desired height position relative to the standing plane is reliably and securely fixed. This embodiment is very practical as a means of making changes to the angular position 71 in open terrain, especially as there are usually no tools to hand and the dexterity of a user is generally hampered by the fact of wearing gloves.

The fixing means 74 for the adjusting mechanism 43 could also be provided in the form of a clamping clasp or as an eccentric lever, in which case the duly provided handle 75 could be used to adjust and forcefully fix the adjusting mechanism 43 in the desired position without the need for tools. Another possibility is to provide the handle 75 for the fixing means 74 in the form of a spring-biassed push-button, in which case the spring action of the spring means would be designed so that the push-button is constantly pushed into a position in which the adjusting mechanism 43 is locked in the desired position.

The pivot bearing 40 between the two support parts 38, 39 is preferably disposed at the uppermost point of the bow-shaped support element 24.

Orifices 51 may optionally be provided in the support element 39, as a result of which the weight and material requirement for the assembled support 25 can be kept low. Nevertheless, relatively extensive support surfaces are provided for supporting a large surface area of the back region of a foot of a user.

As may be seen more particularly from FIG. 4, the middle region between the support 25 and the support element 24 may be kept free for a centrally positioned catch coupling, nevertheless providing a simple and convenient way of enabling the angular position 71 to be individually set via the adjusting mechanism 43 disposed above. The essential factor is that this adjusting mechanism 43 for setting the maximum possible angle between the base plate 11 and the support 25 is disposed exclusively on the support element and does not co-operate directly with elements or surfaces on the support element 24. By contrast with FIG. 3, FIG. 4 also illustrates the lowermost height position of the adjusting mechanism 43 relative to the support 25. As may also be seen primarily from FIG. 4, the rearward support element 38 becomes narrower farther away from the standing surface 19 and may be of a relatively slim design in the upper end region compared with the support element 39 mounted to the fore. The rearward support element 38 predominantly serves as a thrust bearing for the flat support part 39 mounted to the fore and can therefore be of a relatively slim design but should nevertheless be of a relatively high dimensional stability.

Figure 5:
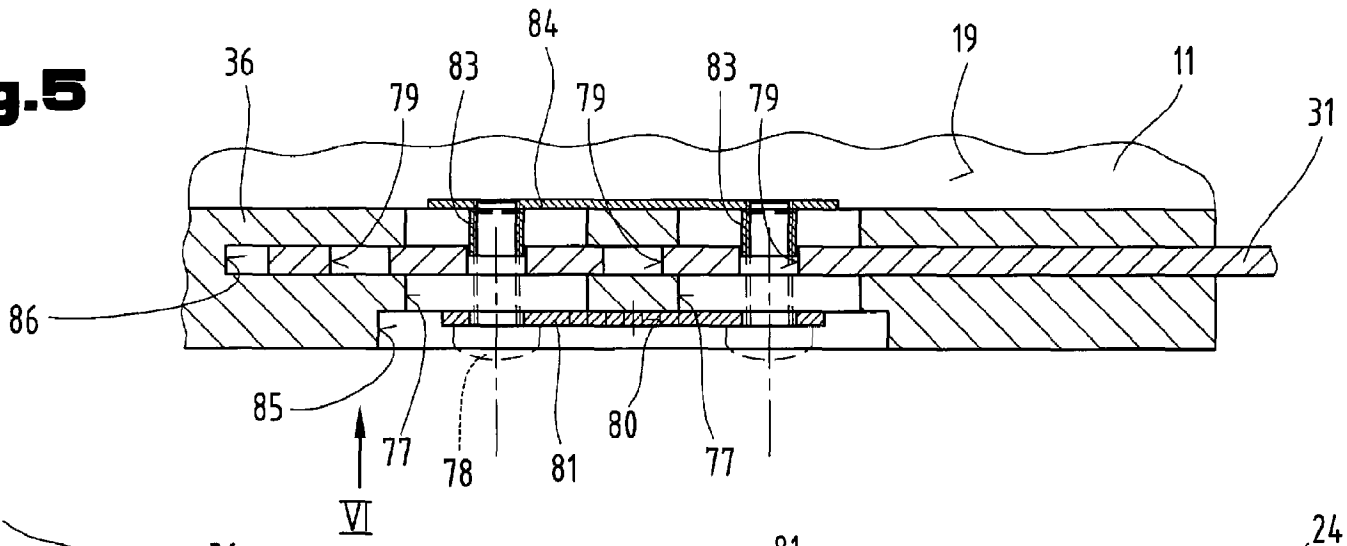
FIG. 5 is a simplified plan view in section showing the transition region between the base plate and the bow-shaped support element.
Figure 6:
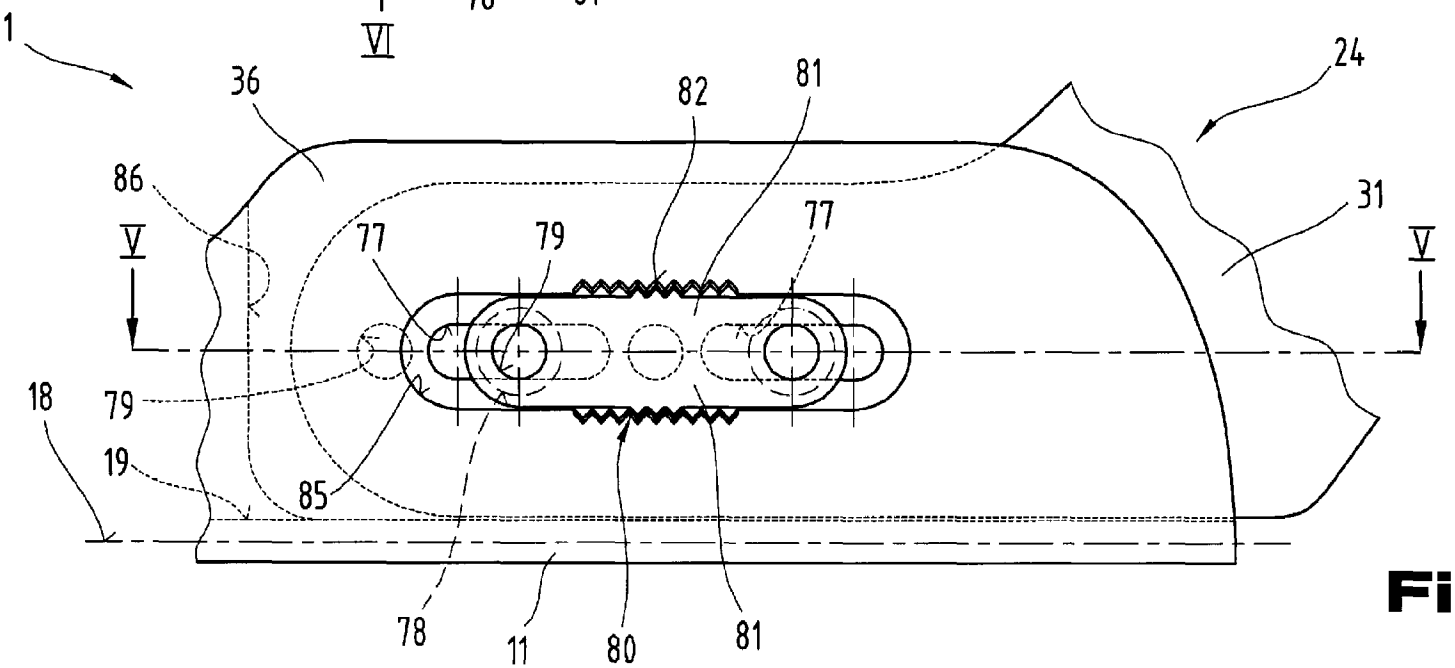
FIG. 6 is a side view of the transition region between the base plate and the support element illustrated in FIG. 5.

FIGS. 5 and 6 illustrate the transition region between the base plate 11 and the support element 24, in particular between the retaining tabs 36 disposed in mirror image about the longitudinal mid axis of the binding mechanism 1 and the legs 31 extending more or less in mirror image.

The connection between the support element 24 and the retaining tabs 36 on the base plate 11 is specifically illustrated. This connection is such—in a manner known per se—that the base plate 14 and the support element 24 can be displaced relative to one another into different positions in the direction of the binding longitudinal axis 18 and fixed. As a result of this adjustability between the support element 24 and the base plate 11 in the direction of the binding longitudinal axis 18, adjustments can be made to accommodate different shoe sizes and tolerances compensated between the coupling parts of the binding mechanism 1 and the associated sports shoe.

To this end—in a manner known per se—at least one oblong orifice 77 is provided in the retaining tabs 36 and/or in the legs 31 of the support element 24. This oblong orifice 77 has at least one fixing element 78 inserted through it, preferably in the form of a screw, thereby connecting the leg 31 of the support element 24 to the respectively associated retaining tab 36. Instead of an oblong orifice 77, bores 79, of which there will preferably be several, may be provided in the legs 31 of the support element 24 spaced at a distance apart from one another in the direction of the binding longitudinal axis 18, through which a fixing element 78 may be selectively inserted, enabling the relative position of the support element 24 to be changed with respect to the base plate 11 in a stepped manner.

To provide a rigid fixing for the desired relative position of the support element 24 with respect to the base plate 11 in the direction of the binding longitudinal axis 18, it has always been necessary in the past to secure the screw-type fixing means 78 with a sufficiently high torque to provide an adequate clamping force between the retaining tabs 36 and the respective co-operating leg and avoid any undesirable shifting within the oblong orifices 77.

It is now preferable to provide at least one friction-enhancing flat portion and/or at least a portion for a positive connection between the parts that are displaceable relative to one other, in particular in the form of teeth 80. These teeth 80 afford a positive mutual meshing of the parts, thereby preventing any shifting of the support element 24 in the direction of the binding longitudinal axis 18, the individual teeth or recesses of the teeth 80 being disposed transversely to the binding longitudinal axis 18. Several sets of teeth and recesses are preferably disposed in rows in the direction of the binding longitudinal axis 18, forming a type of rack.

These teeth are preferably provided on a retaining plate 81. The teeth 80 may be provided at least in certain portions of the peripheral region thereof, in particular on the lengthways peripheral regions or on at least one of its flat sides. Accordingly, in different relative positions, the teeth 80 on the retaining plate 81 may be displaced in the direction of the binding longitudinal axis 18 to engage with a complementary set of teeth 82 on the retaining tab 36. To this end, the teeth 80 and the teeth 82 are of different longitudinal extensions in the direction of the binding longitudinal axis 18. Consequently, when the teeth 80, 82 mesh with one another, the positive connection prevents any relative displacement between the base plate 11 and the support element 24 and the fixing elements 78 used to secure the selected position will serve no other purpose than to ensure that this positive connection between the teeth 80, 82 is maintained, preventing matching sets of teeth 80, 82 from moving out of engagement. The retaining moment or torque to be applied by the screw-type fixing elements 78 as the fixing elements 78 are tightened can be of a relatively low rating compared with an embodiment which does not have the teeth 80, 82.

In order to change the relative position of the support element 24 in the direction of the binding longitudinal axis 18 with respect to the base plate 11, the fixing elements 78 need to be loosened to a sufficient degree or loosened only so far that the retaining plate 81 can be displaced over a sufficient distance to disengage the locking action of the teeth 82 on the retaining tabs 36. The support element 24 can then be pushed into the desired position and the teeth 80 of the retaining plate 81 brought back into engagement with the teeth 82 of the retaining tab 36. The fixing elements 78 can then be tightened down to secure this locking position of the retaining plate 81 relative to the retaining tab 36.

Each leg 31 of the support element 24 is preferably provided with oblong orifices 77 and bores 79 spaced at a distance apart from one another in the direction of the binding longitudinal axis 18. Matching threaded sleeves 83 for the screw-type fixing elements 78 are preferably provided in a counter plate 84, which may be disposed on the internal face of the retaining tabs 36, so that the screw-type fixing elements 78 can be inserted at least partially therein.

Instead of intermittent peripheral toothing on the retaining plate 81, it would naturally also be possible to provide at least one flat side of the retaining late 81 with teeth or to provide it with a friction-enhancing surface, for example by using an intermediate layer of elastomer.

The teeth 82 are preferably provided in the retaining tabs 36 in a longitudinally extending blind bore-type recess 85. This recess 85 is dimensioned so that the retaining plate 81 inserted therein can be displaced by a certain degree in the direction of the binding longitudinal axis 18, corresponding to the desired maximum possible relative adjustment between the support element 24 and the base plate 11. A width or height of this recess 85 will preferably correspond more or less to a width of the oblong retaining plate 81. A diameter of the bores 79 in the retaining plate 81 for receiving the fixing elements 78 more or less corresponds to a diameter of the bolt- or screw-type fixing elements 78.

Each of the two, essentially symmetrically arranged retaining tabs 36 preferably has a slot-shaped open region 86 in each of which a leg 31 of the support element 24 can be received in a relatively displaceable arrangement.

Optionally, a cover element—not illustrated—which may be detached if necessary, may be provided on the retaining tabs 36, which at least partially covers the fixing mechanism, in particular the retaining plate 81 and the orifices 77 or recess 85, enabling it to be uncovered again if necessary to adjust the setting.

The underlying objectives of the independent solutions proposed by the invention may be found in the description.

Above all, the individual embodiments of the subject matter illustrated in FIGS. 1; 2; 3, 4; 5, 6 may be construed as independent solutions proposed by the invention. The related objectives and solutions may be found in the detailed descriptions of these drawings.

What is claimed is:

1. A binding mechanism for a snowboard, the binding mechanism having a longitudinal axis and comprising (a) a base plate for fixing the binding mechanism to the snowboard and having a standing plane for supporting a sports shoe, (b) a highback extending substantially perpendicularly thereto for supporting a rearward cuff of a back of the sports shoe, the highback being pivotal to a limited degree about a pivot axis extending substantially parallel to the standing plane of the base plate and substantially transversely to the longitudinal axis of the binding mechanism, and the highback consisting of (1) a first and a second highback part arranged one after the other in the direction of the longitudinal axis and substantially overlapping in top regions of the first and second highback parts remote from the base plate, the first and second highback parts being of a substantially shape-retaining material and connected to each other in end regions lying immediately adjacent to the base plate, and (c) an adjusting mechanism for adjusting a distance between the first and the second highback part extending in the direction of the longitudinal axis in the substantially overlapping top regions remote from the base plate.

2. Binding mechanism as claimed in claim 1, wherein the first and the second highback part are connected to one another by a pivot bearing.

3. Binding mechanism as claimed in claim 2, wherein the pivot bearing forms a pivot axis between the first and the second highback part aligned substantially parallel with the standing plane.

4. Binding mechanism as claimed in claim 3, wherein the pivot axis for the highback and the pivot axis between the highback parts are spaced a distance apart from one another in a vertical direction.

5. Binding mechanism as claimed in claim 3, wherein the pivot axis for the highback and the pivot axis between the first and second highback part are identical.

6. Binding mechanism as claimed in claim 1, wherein the highback is mounted at a vertical distance from the standing plane on a bow-shaped support element connected to the base plate.

7. Binding mechanism as claimed in claim 6, wherein a rearward pivoting action of the first highback part is restricted in the direction of the longitudinal axis by a stop surface which is a rigid projection on the first highback part and is designed to abut with a counter surface on the support element.

8. Binding mechanism as claimed in claim 1, wherein a rearward pivoting action of the first highback part about the pivot axis is restricted in the direction of the longitudinal axis by at least one stop surface.

9. Binding mechanism as claimed in claim 8, wherein the stop surface is provided on a stop element mounted on the first highback part so as to be adjustable and fixable in a vertical direction.

10. Binding mechanism as claimed in claim 1, wherein the adjusting mechanism comprises a spacing element which is adjustable in at least two positions between the first and the second highback part.

11. Binding mechanism as claimed in claims 1, wherein the adjusting mechanism is a lever or cam arrangement pivotable through a dead centre position.

12. Binding mechanism as claimed in claim 11, wherein the adjusting mechanism is designed rapidly to adjust and release the distance between the first and the second highback part by a displacement of the lever or cam arrangement.

13. Binding mechanism as claimed in claim 1, wherein the adjusting mechanism is designed for pre-setting or pre-selecting a desired minimum distance between the first and the second highback part in the top regions on assuming an active position of the adjusting mechanism.

14. Binding mechanism as claimed in claim 1, wherein the adjusting mechanism is adjustable and fixable relative to the highback in the vertical direction.

15. Binding mechanism as claimed in claim 14, wherein the adjusting mechanism is displaceably retained on a plane that is inclined relative to the support surface of the first highback part.

16. Binding mechanism as claimed in claim 1, wherein the adjusting mechanism cooperates with an oblique surface, which is inclined relative to a rear face or support surface on the adjacent highback part.

17. Binding mechanism as claimed in claim 1, wherein the adjusting mechanism has a manually operable pivotal handle for adjusting said distance.

18. Binding mechanism as claimed in claim 1, wherein the adjusting mechanism has a pivotably mounted lever for rapidly adjusting and releasing an angle of extension of the first highback part relative to the second highback part.

* * * * *